United States Patent [19]

Gross et al.

[11] 4,070,987

[45] Jan. 31, 1978

[54] EDGE COATING APPARATUS

[75] Inventors: William G. Gross, York; Henry A. Long, Jr., Columbia; John R. Yamshak, Lancaster, all of Pa.

[73] Assignee: Armstrong Cork Company, Lancaster, Pa.

[21] Appl. No.: 743,048

[22] Filed: Nov. 18, 1976

[51] Int. Cl.[2] ..... B05C 1/02

[52] U.S. Cl. ..... 118/257

[58] Field of Search ..... 118/239, 257, 106, 209; 68/204

[56] References Cited

U.S. PATENT DOCUMENTS

| | | | |
|---|---|---|---|
| 492,798 | 3/1893 | Hatfield | 118/257 |
| 778,709 | 12/1904 | Robertson | 118/257 X |
| 1,259,925 | 3/1918 | Stommel | 118/257 X |
| 2,659,341 | 11/1953 | Taggart | 118/257 X |
| 3,244,139 | 4/1966 | Brown et al. | 118/257 X |

*Primary Examiner*—John P. McIntosh

[57] ABSTRACT

An edge coating apparatus adapted to apply a liquid coating to the shaped edge portions of work pieces. The apparatus is particularly adapted for applying a finish coat of paint to the beveled and adjacent non-parallel planar surfaces of the edges of previously face-coated fiberboard. The apparatus comprises an endless belt mounted on and driven around four standard pulleys located 90° apart in a horizontal plane. The applicator side of the belt is shaped to conform to the main configuration of the board edge to be coated. The other side of the belt acts as a drive. Paint is applied to the belt at a point prior to its arrival at the point of paint application. Resilient means is provided for biasing the belt into and maintaining contact with the work piece. Due to the configuration of the applicator side of the belt and the pressure maintained on the belt at the point of paint application, the paint is forced into any voids in the board's edge surface and is applied to the lower surface of the tongue and a small vertical edge portion of the board which extends from the beveled edge to the tongue's lower surface.

5 Claims, 4 Drawing Figures

EDGE COATING APPARATUS

BACKGROUND OF THE INVENTION

1. Field of the Invention

The invention relates to an apparatus for applying a liquid coating to the edge portions of work pieces. More particularly, the invention relates to a belt mounted on and driven around pulleys mounted in a horizontal plane, the belt having a paint-applying surface configuration which conforms generally to that of the edge portion of a work piece to be coated. The apparatus is used to coat raw, beveled and tenoned edge portions of previously face coated, decorated panel materials such as fiberboard ceiling tiles and panels.

2. Description of the Prior Art

In the formation of decorative fibrous panel board and acoustical ceiling tiles in the past, a prime coat and an intermediate coat of paint were applied to one surface of the material in the course of its manufacture. The material was then cut into the desired length and width. The boards were then tenoned, and bevels formed thereon were ironed and coated with a prime coat of paint. The boards and bevels thereon then received a finishing coat of paint in a separate operation.

It has been recognized in the past that it would be desirable to eliminate the separate operation required for applying the finish coat and be able to obtain a finish-coated work piece directly from the tenoner. However, coating of the beveled edges formed in the tenoning operation has presented a problem in the past. Since fiberboard is porous, the cross-cut surfaces of the beveled portions have loose fibers, fiber ends, and voids which, when painted, have a rough texture and a color which contrasts with the coated face of the work piece. It has also been desirable, due to the dimensional instability of the product, to be able to not only coat the angled beveled edge portion of the work piece, but to also coat part of the remaining edge detail consisting of both a vertical and a horizontal surface since this would eliminate dark lines produced by exposed, unpainted board as the tiles grow and shrink while adjusting to humidity changes after installation. Former methods of coating the edge portions also resulted in portions of the edges being skipped and receiving little or no paint. This resulted because the bevels must be coated consistently and accurately at line speeds up to 200 feet per minute, and because the boards may shift slightly as they travel through the tenoner or the board may be warped slightly. Another problem involved in attempting to obtain a finish-coated product directly from the tenoner arises from the fact that, since the face of the board would necessarily be finished prior to the bevel coating, complete coverage of the bevel without any noticeable bevel paint on the face is required. Application of coatings of the desired thickness on the edge portions of the work pieces have also been a problem in the past.

Typical of the apparatus used in the past to coat beveled edges of panel boards are those disclosed in U.S. Pat. Nos. 2,165,210 and 2,811,133. In the case of U.S. Pat. No. 2,165,210, a rotatable disc having a circular plane face is inclined at an angle to the horizontal and dips into a supply of coating composition as it rotates, thus transferring a film of the coating composition to a beveled edge surface of a work piece. In U.S. Pat. No. 2,811,133, a similar arrangement is used for picking up the coating material and transferring it to another surface; however, in this case, the coating composition is transferred to a smooth transfer roll, which in turn transfers the coating to the beveled edge of the work piece.

U.S. Pat. No. 3,015,301 discloses an apparatus for painting grooves or bevels in the surface of a fiber wallboard unit and comprises a vertical paint transfer wheel having a beveled paint-carrying and applying peripheral face. A paint spray gun mounted adjacent thereto supplies a uniform coat of paint directly to the peripheral face of the transfer wheel for application to the grooved or beveled portion of the work piece.

U.S. Pat. No. 1,268,891 relates to an apparatus for applying a coating to ceramic tiles. The apparatus includes an endless belt which is mounted for travel around a pair of rollers and is provided on its outer surface with transverse grooves or channels. As the belt advances around the rollers, a portion of the belt is submerged in a tile glazing solution contained in a trough or reservoir. Thus, the grooves or channels are filled with the solution which is then carried upwardly over the top roller and applied to the surface of a tile being conveyed past the applicator.

U.S. Pat. No. 3,185,130 relates to a coating apparatus for applying a layer of liquid coating material of uniform thickness to the edge portion of a work piece. The apparatus includes a pick-up roller, the lower portion of which is immersed in a coating material. As the pick-up roller rotates, the coating material is carried into contact with an applicator roller which applies the material to an article being conveyed therepast. The applicator roller is continuously urged toward the article being coated by means of a coil compression spring, thereby assuring the desired contact pressure between the applicator roller and the article being coated.

None of the prior art disclosures provide a solution to the problems aforementioned.

The coating applicator apparatus of this invention provides a device which will enable finish-coated, beveled edge ceiling boards and panels to be obtained directly from the tenoning operation, thus eliminating a step in the production operation and resulting in a substantial savings of labor, material-handling time, and coating material.

SUMMARY OF THE INVENTION

According to the present invention, there is provided an apparatus for applying a liquid coating to the shaped edge portions of work pieces. More particularly, the apparatus is adapted for simultaneously applying a finish coating to the beveled edge portions of fiberboard and to the adjacent vertical and horizontal portions thereof as well. This eliminates dark lines produced by exposed, unpainted board as they grow and shrink while adjusting to humidity changes after installation.

The edge coating apparatus of the present invention comprises a belt mounted for travel in a horizontal plane around four pulleys located 90° apart. The belt is formed by joining two standard V-belt sections back to back, thus allowing one side of the belt to act as a drive and the other side to be used as the applicator. The paint-applying surface of the applicator side of the belt is shaped to conform generally to the configuration of the edge portion of the work piece to be coated. This is accomplished by cutting a bevel on the applicator surface of the belt to match the bevel on the edge portion of the work piece to be coated, the bevel on the belt beginning at a point spaced about $\frac{1}{8}$ inch away from the joining line of the belts and proceeding downwardly at an angle to the vertical surface on the applicator side of the belt. The face of one pulley, located where the paint is transferred from the belt to the edge portions of the work piece, is partially machined off to avoid contact of the pulley with the work pieces. This pulley also acts as a support for the belt while the paint is being applied. The pulley at the painting location and one located 180° opposite thereto are tied together by means of a shaft which is spring loaded to allow horizontal movement of the pulley at the painting point and result in automatic maintenance of the proper contact between the applicator surface of the belt and the work pieces. This arrangement assures an even application of a coat of paint to the edge surfaces of the boards, even though some of them may be slightly warped or misaligned. Thus, the improved edge coating apparatus of this invention makes it possible to provide a finish coat of paint on beveled edge ceiling tile or panel boards in a two-step process instead of the three-step process required in the past. Further, through the use of a combination applicator and drive belt operating in a horizontal plane, an improved means is provided for conveying the coating material in a straight path from its point of application to the belt to the point of its application to the board's edge. This eliminates one of the problems encountered in using the wheel or beveled disc type of applicator of the past. Namely, at current production line speeds, the speed of rotation of the wheel or disc and the resulting centrifugal force would tend to throw the paint off of the disc and produce less than desirable results.

BRIEF DESCRIPTION OF THE DRAWING

In the accompanying drawing, which forms part of this specification.

DESCRIPTION OF THE PREFERRED EMBODIMENT

Figure 1:
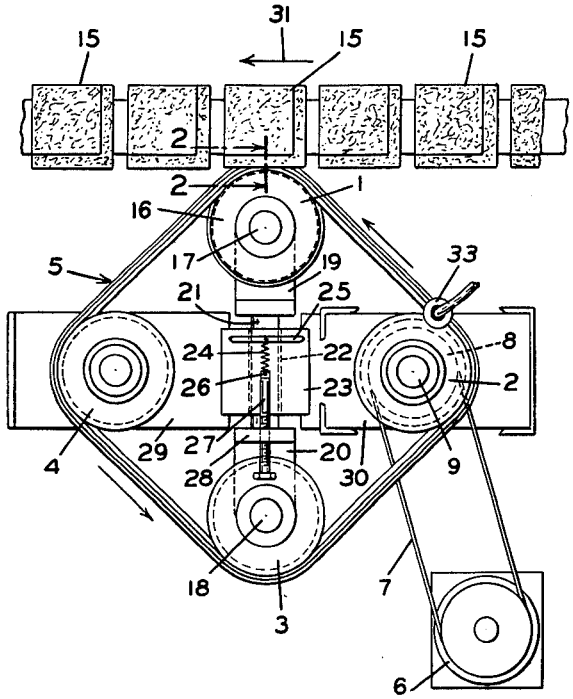
FIG. 1 is a top plan view showing the edge coating apparatus of this invention in operative relation with a plurality of work pieces being conveyed past the applicator.
Figure 3:
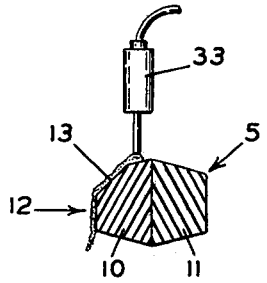
FIG. 3 is a cross-sectional view of the combination applicator-drive belt with the nozzle for applying paint thereto shown in position thereabove.

Referring to the drawings, there is shown in FIG. 1 the preferred embodiment of the edge coating apparatus of this invention. The coating apparatus includes four pulleys 1, 2, 3, and 4 located 90° apart in a horizontal plane. A combination applicator-drive belt 5 is driven around pulleys 1, 2, 3, and 4 by a drive means 6 through belt 7 and pulley 8 mounted on shaft 9, which also carries pulley 2. As more clearly shown in FIGS. 2 and 3, the applicator-drive belt comprises two standard V-belts 10 and 11 which have been joined together back to back. The applicator side 12 of the composite belt 5 is beveled as at 13 at an angle corresponding to the angle of the bevel 14 (FIG. 2) on a work piece 15, the edge portion of which is to be coated. Thus, the applicator side 12 of the composite belt 5, in cross section, has the shape of a truncated regular trapezoid. That is, the outer face and the back surfaces of the belt 10, which form the applicator side 12 of the composite belt structure 5, are parallel and of different lengths; the sides are inclined; and, the included angle between each side and the base (or back) is equal, yielding a regular trapezoid. This is truncated by cutting an upper corner off, thus yielding a truncated regular trapezoid. Pulley 1, located where the paint is transferred to the work piece, has the top face 16 thereof partially machined off to eliminate interference with work pieces passing thereby. Pulley 1 also functions as a support for the belt 5 when paint is being applied to the edge of a work piece. Pulley 1 and pulley 3, located 180° opposite thereto, are mounted on shafts 17 and 18, respectively, extending from support members 19 and 20, which are tied together by means of shaft 21 mounted for sliding action in bushing 22 in block 23 which, in turn, is mounted on frame sections 29 and 30. A spring means 24 is provided for urging pulleys 1 and 3 and belt 5 toward work piece 15 being fed thereby. The spring 24 is fastened to clip 25 mounted on block 23 and to the end 26 of an adjusting bolt 27 threaded through an opening in upstanding portion 28 of support member 20. This assures that the applicator side 12 of the belt 5 in general and the beveled portion 13 thereof in particular will be automatically urged into constant engagement with the beveled portion 14 on the work piece 15 with the proper pressure to coat the bevel and adjacent non-parallel planar surfaces of the edge portions of the work piece and force the paint into voids and irregularities therein when the work pieces are being coated at the desired operating speeds.

Although the invention is described as being adapted to be used with the applicator-drive belt entrained over four pulleys, obviously a greater or lesser number could be used without departing from the concept of the invention.

The edge coating apparatus of this invention is particularly adapted for applying a finish coat of paint to the beveled and adjacent non-parallel planar surfaces of fiberboard in the form of panels or ceiling tile. Ceiling tile is normally made in square pieces, two of the edges thereof each having a beveled portion, a small vertical portion, and a tongue portion. The remaining two edges each have a grooved portion with a bevel on the lower edge portion of the tile. Although only a single edge coating unit is shown in FIG. 1 of the drawings as being used to coat the edge portions of the work pieces 15, obviously, in practice, a similar edge coating unit would be used to coat the bevel on the opposite side of the tile. Thus, the common line of thrust would be medial of the work piece and would introduce no tendency to misalign the articles. A similar arrangement and procedure is then used to coat the two edges of the tile not coated by the first coating units.

Figure 2:
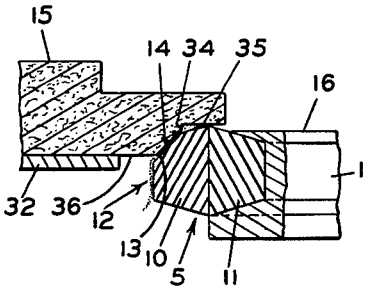
FIG. 2 is a sectional view taken along lines 2—2 of FIG. 1.

In use, a plurality of work pieces 15, such as ceiling tile, are moved in the direction indicated by arrow 31, on a conveyor 32 operated by suitable drive means (not shown) past pulley 1 of the edge coating apparatus (and a similar unit, not shown, on the opposite side). Portion 10 of the applicator belt 5 would be positioned with respect to a work piece 15 as shown in FIG. 2 of the drawings as the belt 5 moves around pulleys 1, 2, 3, and 4. As indicated by lines 2—2 in FIG. 1, FIG. 2 is taken at the point where the paint is transferred from the applicator portion of the belt 5 to the edge portion of the work piece 15, which projects laterally beyond the edge of the conveyor 32. As shown in FIG. 1 of the drawings, and more clearly in FIG. 3, paint is applied to portion 10 of belt 5 at a point prior to the point of paint application to the work piece 15, by means of a nozzle 33, from a supply source (not shown). The paint is applied to the upper surface of portion 10 of belt 5 at a point just above the beveled portion 13 thereof, (see FIG. 3) and flows downwardly following the contour of portion 10. When portion 10 of belt 5 carrying the paint arrives at the point where the paint is applied to the work piece 15, the beveled portion 13 of the belt 5 comes in contact with the correspondingly beveled portion 14 on the edge of work piece 15. At this point, since beveled portion 13 of the belt 5 is being pressed lightly against beveled portion 14 of the work piece by means of spring 24 which, as previously described, acts to bias pulleys 1 and 3 toward the work piece, part of the excess paint on the belt is squeezed upwardly and serves to coat the vertical edge 34 of the work piece 15 and also a portion of the bottom surface 35 of the tongue thereof. Additional excess paint is forced downwardly and follows the contour of the side 12 of belt 5 and is thus carried away from the previously finish-coated face 36 of work piece 15. After paint has been applied to the edge of the work piece 15 by the belt 5, any paint remaining thereon may be removed by conventional means such as an air blast. Thus, a well-coated edge configuration is obtained on the board at operating speeds of about 200 feet per minute with no application of paint to previously finished surfaces where this would be very undesirable.

By varying the location of the paint-applying nozzle 33, the location of the paint stream and quantity of paint on the belt can be controlled. This adjustment is sometimes desirably made as a further aid in eliminating "skippers" due to board warpage and/or misaligned boards. The belt can be run in the same or opposite direction with respect to the flow of the work pieces. When the belt and work pieces are moving at the same speed, a simple transfer of paint to the work pieces is achieved. However, various forms of smearing, rubbing, and smoothing actions can be accomplished when the paint is transferred at various speed differences between the belt and the work pieces.

It will be appreciated that a wide variety of edge shapes and sizes can be coated by applicator devices in accordance with the present invention through the use of particularly configured and appropriately dimensioned surfaces on the applicator portion of the belt.

Figure 4:
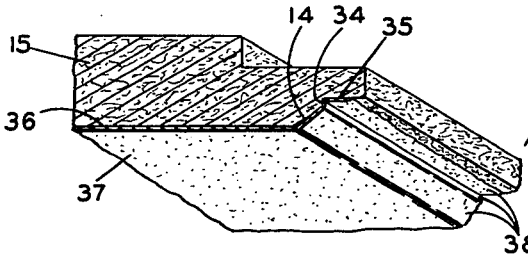
FIG. 4 is a sectional perspective view of the work piece showing the coated edge detail together with the previously applied finish coating on the face thereof.

In FIG. 4 of the drawings there is shown the finish coated work piece 15 having a previously-applied finish coating 37 on the face 36 thereof, and coating material 38 applied to edge portions 14, 34, and 35 by the edge coating apparatus of this invention.

Upon completion of coating the bevels and adjacent edge surfaces, the paint is normally dried with heat guns or the like. At this point, the tile can be packaged as a finished product, rather than moved to another paint line for an additional operation, as was necessary prior to the development of the edge coating apparatus of this invention.

What is claimed is:

1. An edge-coating apparatus for simultaneously applying liquid coating material to adjacent non-parallel planar surfaces of the edge portions of work pieces, said apparatus comprising:

a. a flexible endless belt having an inner drive side and an outer liquid-transporting and applying side including 1. a first upper surface portion being outwardly and downwardly inclined in a plane different from the planes of the non-parallel planar edge surfaces of the work piece to be coated, an upper edge on said first surface portion of the belt, adapted to be in moving contact, at the point of application of the coating material, with a downwardly facing planar surface of the edge of the work piece being moved past said apparatus, a lower edge on said first surface portion of the belt, adapted to lightly contact, at the point of liquid application, a planar surface on the edge of the work piece which is non-contiguous and non-parallel with said downwardly facing surface thereon, said first upper surface portion on the liquid-applying side of said belt being further adapted to apply coating material to at least two adjacent non-parallel planar surfaces of said work piece edge portion;

2. a second liquid-applying surface portion on said belt having a surface configuration substantially similar to that of a portion of the edge of a work piece to be coated thereby, said second surface portion extending from and being downwardly inclined with respect to said first surface portion; and 3. a substantially vertical surface portion on said belt extending downwardly from said second surface portion, b. rotatable mounting means for said endless belt, said mounting means comprising a plurality of pulleys all mounted for rotation in the same horizontal plane;

c. means for imparting rotation to the mounting means;

d. means for supplying liquid to the liquid-applying side of said belt at a point preceding the point of liquid application;

e. means for bringing the edge portion of a work piece and the liquid-applying side of said belt into movable contact with each other; and f. resilient means mounted for reciprocal movement in a horizontal plane for biasing said liquid-applying side of said belt into and maintaining its contact with the edge portion of a work piece being moved therepast.

2. The apparatus of claim 1 wherein said belt is a composite structure comprising an inner drive side formed of a first belt having the cross-sectional shape of a regular trapezoid and an outer paint-applying side formed of a second belt having the cross-sectional shape of a truncated regular trapezoid, said belts being joined together at those surfaces which form the bases of their trapezoidal cross sections.

3. The apparatus of claim 1 wherein at least one of said pulleys is positioned at the location where paint is applied to the work piece and has a partially machined-off top surface.

4. The apparatus of claim 3 wherein the mounting means for the pulley positioned at the location of application of paint to the work piece, and the mounting means for another pulley positioned 180° opposite thereto, are joined by horizontally movable connecting means.

5. The apparatus of claim 1 including adjusting means for the resilient means biasing said paint-applying member into contact with a work piece.

* * * * *